United States Patent [19]

Blair

[11] 4,290,231

[45] Sep. 22, 1981

[54] WINDOW ASSEMBLY

[75] Inventor: Joseph N. Blair, Detroit, Mich.

[73] Assignee: Mamie I. Blair Adams, Detroit, Mich.

[21] Appl. No.: 63,603

[22] Filed: Aug. 3, 1979

[51] Int. Cl.[3] ..... E05D 15/22

[52] U.S. Cl. ..... 49/173; 49/184

[58] Field of Search ..... 49/172, 173, 176, 183, 49/184

[56] References Cited

U.S. PATENT DOCUMENTS

| | | | |
|---|---|---|---|
| 722,675 | 3/1903 | Christenson | 49/173 |
| 1,663,932 | 3/1928 | Ziganek et al. | 49/173 X |
| 2,011,319 | 8/1935 | Howard | 49/183 |
| 2,724,155 | 11/1955 | Hindin | 49/183 X |
| 2,824,340 | 2/1958 | Blair | 49/173 |

*Primary Examiner*—Kenneth Downey

*Attorney, Agent, or Firm*—Cullen, Sloman, Cantor, Grauer, Scott & Rutherford

[57] ABSTRACT

A window assembly comprises a hollow frame with a trackway mounted upon each frame side including opposed pairs of inner and outer channel tracks of dovetail shape in cross section. Opposed pairs of channel slides of dovetail shape are movably mounted in opposed tracks. A window support bracket overlies each slide and adjacent its lower end is pivotally mounted thereon. Upper and lower sashes are interposed between pairs of opposed support brackets and secured thereto. The upper and lower sashes and connected channel slides are adapted for vertical adjustments along the inner and outer tracks respectively, and the upper and lower sashes and connected support brackets are adapted for selective inward pivotal movement approximately 90° to facilitate cleaning.

1 Claim, 7 Drawing Figures

FIG.4
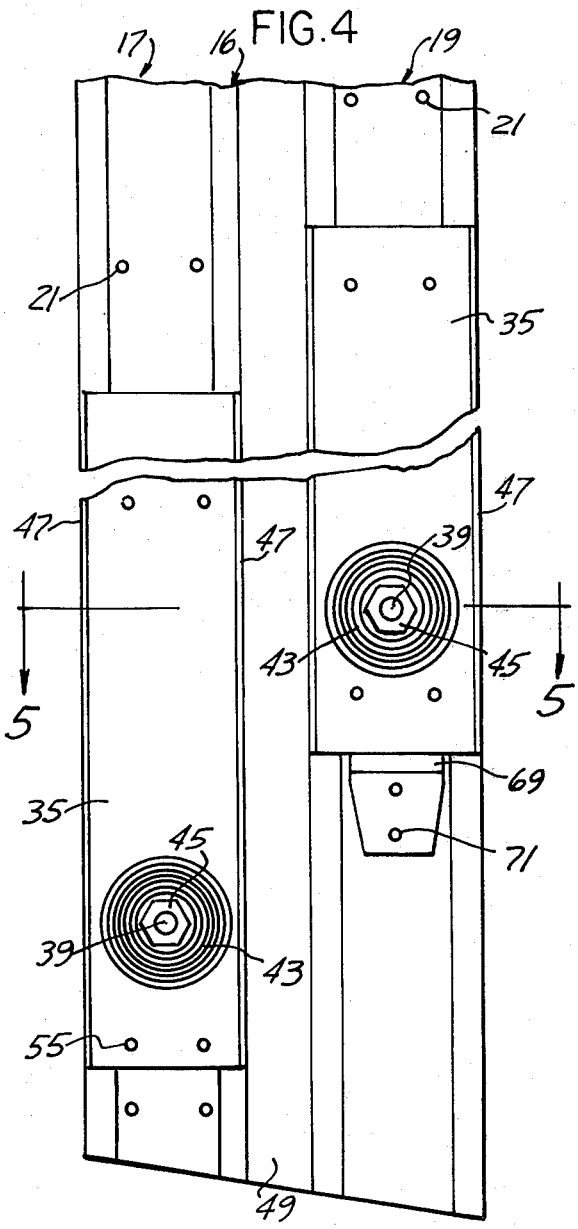
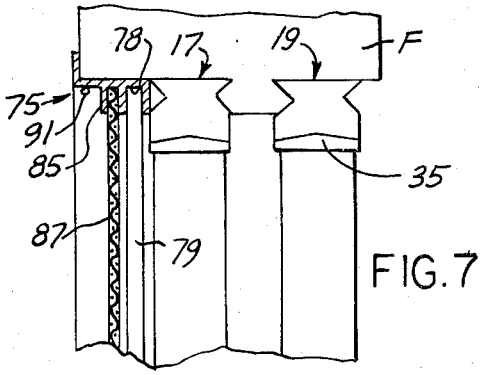
FIG.7
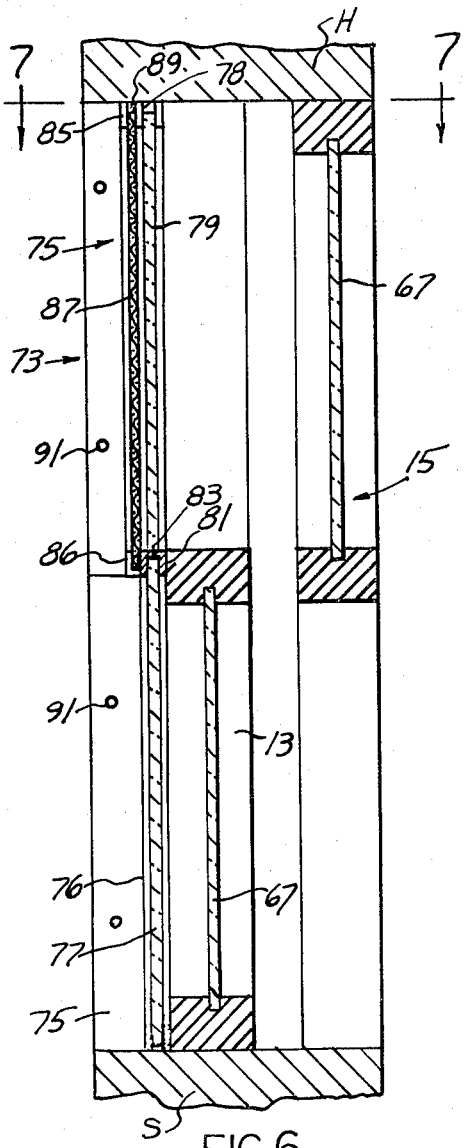
FIG.6
FIG.5
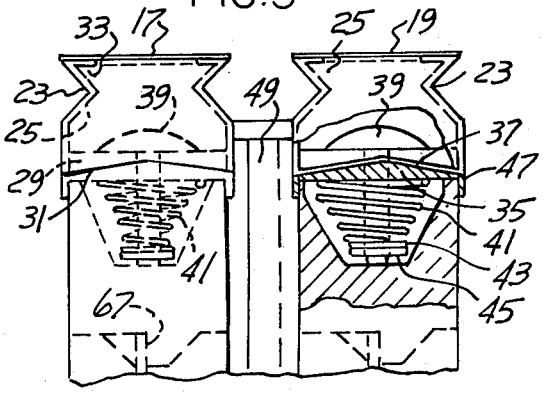

WINDOW ASSEMBLY

BACKGROUND OF THE INVENTION

In the conventional window assembly involving inner and outer trackways with upper and lower window sashes movably mounted thereon the primary difficulty resides in washing the exterior of each window sash from the interior of the building or room. In many cases access to the window exterior must be achieved by working from the outside.

Sometimes the problem has been solved by pivotally mounting the window so that it is capable of swinging upon a vertical axis or a horizontal axis such that the exterior of the window assembly can be disposed upon the interior of a building or room. This does not solve the problem in the general case of double hung conventional windows which are adapted for sliding movements within trackways.

SUMMARY OF THE INVENTION

It is an object of the present invention to provide a window assembly which comprises a hollow frame with opposed sides, a sill and a header and wherein a trackway is mounted upon and secured to each frame side including opposed pairs of inner and outer channel tracks of dovetail shape in cross section. Opposed pairs of channel slides of similar shape are movably mounted within opposed tracks. A window support bracket overlies each slide and adjacent its lower end is pivotally mounted thereon. A lower sash is interposed between a pair of opposed support brackets and secured thereto; and an upper sash is interposed between an additional pair of opposed support brackets and secured thereto. The upper and lower sashes and connected channel slides are adapted for vertical adjustments along the inner and outer tracks respectively. The upper and lower sashes and connected support brackets are adapted for selective inward pivotal movement relative to said tracks, approximately 90° to facilitate cleaning thereof.

In the present construction the outer surface of each channel slide has an enlongated V-shape groove. The outer surface of each window support bracket has a corresponding V-shaped base which is normally nested and retained within a channel slide groove when the sashes are in an upright position, and is angularly displaced from said groove when the sashes are pivoted inwardly.

The pivotal mounting of each window support bracket upon a channel slide includes a headed bolt within the channel slide projecting inwardly thereof and through the window bracket and with a coil compression spring anchored upon said bolt and bearing against the window bracket for normally biasing the bracket base into the slide groove. Upon rotation of the brackets and interposed window sash with respect to said tracks, the respective slides cam the brackets inwardly against the action of said springs for biasing the window sash and brackets in any selected angular position of adjustment. On pivotally returning the assembled window and brackets to an upright position said brackets are adapted to snap into the corresponding slide grooves respectively.

The window brackets are individually formed with inwardly directed channels which cooperatively receive opposite sides of the window sash which are nested and retained therein. The window brackets are individually secured to corresponding sides of the window sash.

A stop is provided upon the outer track in the path of downward movement of the outer sash, and spaced above the pivotal mounting of the inner sash for limiting downward movement of the outer sash and whereby with the outer sash lowered to the stop both sashes may be selectively rotated inwardly into substantial parallel relation.

It is another object of the present invention to provide an improved thermal window assembly upon the interior of the double hung sash assembly and wherein suitable channels are provided upon the frame sides adapted to cooperatively and sealingly receive a pair of upper and lower storm windows.

These and other objects will be seen from the following specification and claims in conjunction with the appended drawings.

THE DRAWINGS

FIG. 4 is a fragmentary section taken in the direction of arrows 4—4 of FIG. 3.

FIG. 5 is a fragmentary plan section taken in the direction of arrows 5—5 of FIG. 4.

FIG. 6 is a fragmentary section taken in the direction of arrows 6—6 of FIG. 1, on an increased scale and showing the positioning of a storm window assembly.

FIG. 7 is a fragmentary section taken in the direction of arrows 7—7 of FIG. 6.

It will be understood that the above drawings illustrate merely a preferred embodiment of the invention for illustration, and that other embodiments are contemplated within the scope of the claims hereafter set forth.

DETAILED DESCRIPTION OF AN EMBODIMENT OF THE INVENTION

Figure 1:
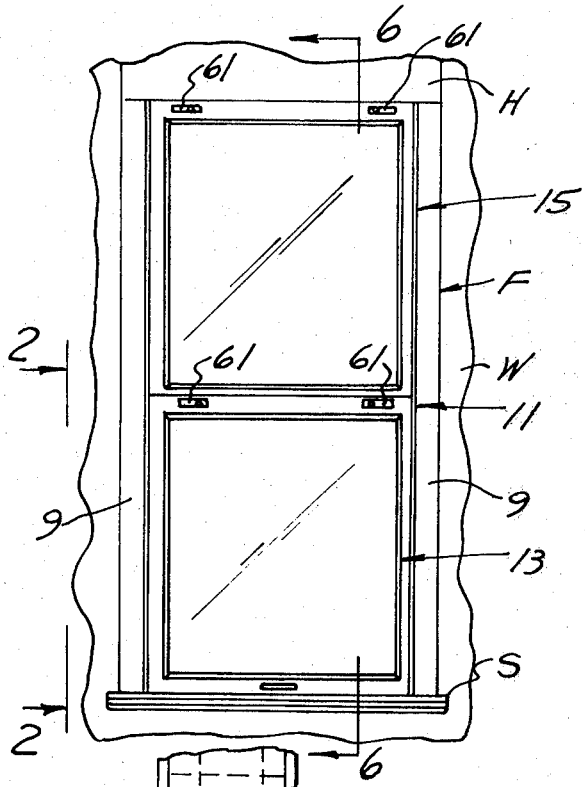
FIG. 1 is an inside elevational view fragmentarily showing a building wall and nested therein the present window assembly.

Referring to the drawings and particularly FIG. 1, the interior of a building wall is generally shown fragmentarily at W having a rectangular opening within which is disposed a frame F including opposed upright frame sides 9, sill S and header H. Within said frame is disposed the present window assembly 11 of the double hung type. The window assembly includes lower sash 13 and upper sash 15 suitably glazed in a conventional manner.

Formed trackways 16, of sheet metal for illustration, are mounted upon and secured to each frame side and include upright inner track 17, parallel outer track 19 and a spacer 49 therebetween, FIGS. 4 and 5. The respective trackways are secured to the frame sides as by fasteners 21 so that there is an opposed pair of inner tracks 17 adapted to slidably receive lower sash 13, and an opposed pair of outer tracks 19 adapted to slidably receive the upper sash 15 as in FIG. 6.

The respective inner and outer tracks have formed notches 23 to provide inner and outer channel tracks which are of dovetail shape in cross section as at 17 and 19 respectively. Within each of the tracks are arranged channel slides 25, of dovetail shape in cross section, which are arranged in opposed pairs. Each channel slide includes on the inner surface thereof a base 29 which has formed in its outer surface a V-shaped groove 31. The surfaces which define said groove are arranged at an obtuse angle to provide a shallow channel. Rear portions of the channel slides have opposed spaced inturned ends 33.

An elongated window support bracket 35 overlies the base 29 of each of the channel slides 25 and adjacent its lower end is pivotally mounted thereon by the outwardly extending headed bolt 39, FIG. 5. Each window support bracket includes a V-shaped base 37 corresponding to the inclination of the V-groove 31 upon the slide base 29 and adapted for cooperative nesting therein.

The pivotal mounting for the respective window support brackets includes the bolt 39 which projects inwardly from behind the respective channel slide bases 29 and through a corresponding aperture within the window support bracket. A conically shaped compression spring 41 is positioned over said bolt, bears against the inner surface of the bracket base 37 and is retained thereon by cap washer 43 and fastener 45 or self-locking jam nut secured over the end of said bolt.

By this construction the corresponding window support brackets are pivotally mounted upon the adjacent vertically adjustable channel slide with the V-shaped base 37 nested within the correspondingly shaped groove 31 in said channel slide and biased therein by said compression spring.

Each of the support brackets have along its opposite sides the side flanges 47 adapted to cooperatively receive side portions of the individual window sash. The window support brackets are further secured to the adjacent window sash by a series of fasteners 55 shown in FIG 3.

Each of the upper and lower sashes 15 and 13 include the upright side rails 51. Each such side rail has upon the outer surface thereof adjacent its lower end a conical recess 53, adapted to cooperatively receive conical compression spring 41 and the associated bolt 39 and fastener in the manner shown in FIGS. 3 and 5.

Figure 3:
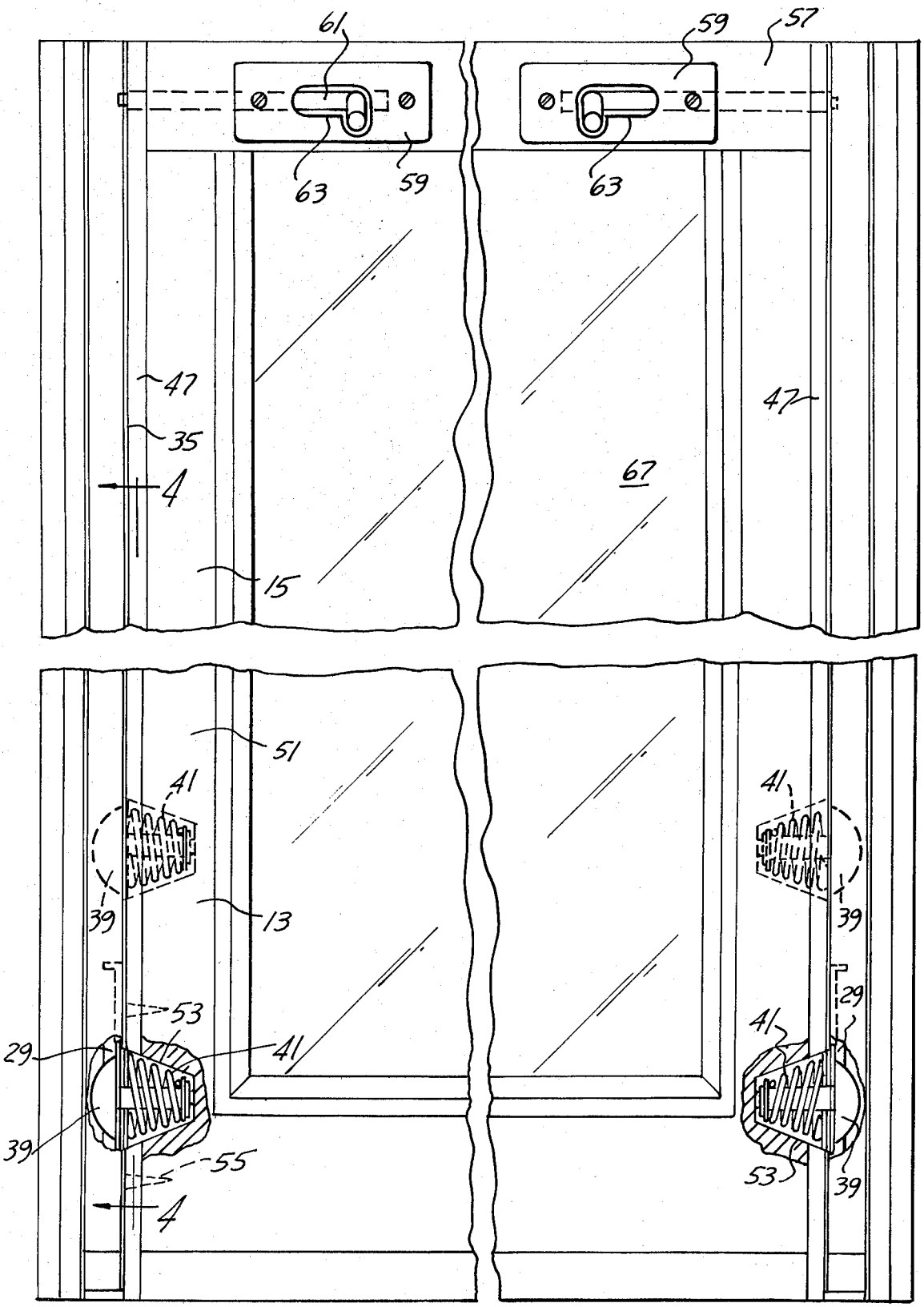
FIG. 3 is a fragmentary front elevational view partially broken away corresponding to the upright positioning of the lowered upper sash and lower window sash shown in FIG. 2.

Each of the window sashes include a top rail 57 and adjacent side portions thereof there are provided and secured the latch plates 59 having bayonet slots 63 therein adapted to cooperatively receive the handle of the transverse latch bolt 61. In FIG. 3 the outer end of said latch bolt is cooperatively and retainingly nested within a corresponding recess formed in the channel slide 25 for securing the respective upper and lower window sashes in an upright position within the corresponding track.

Figure 2:
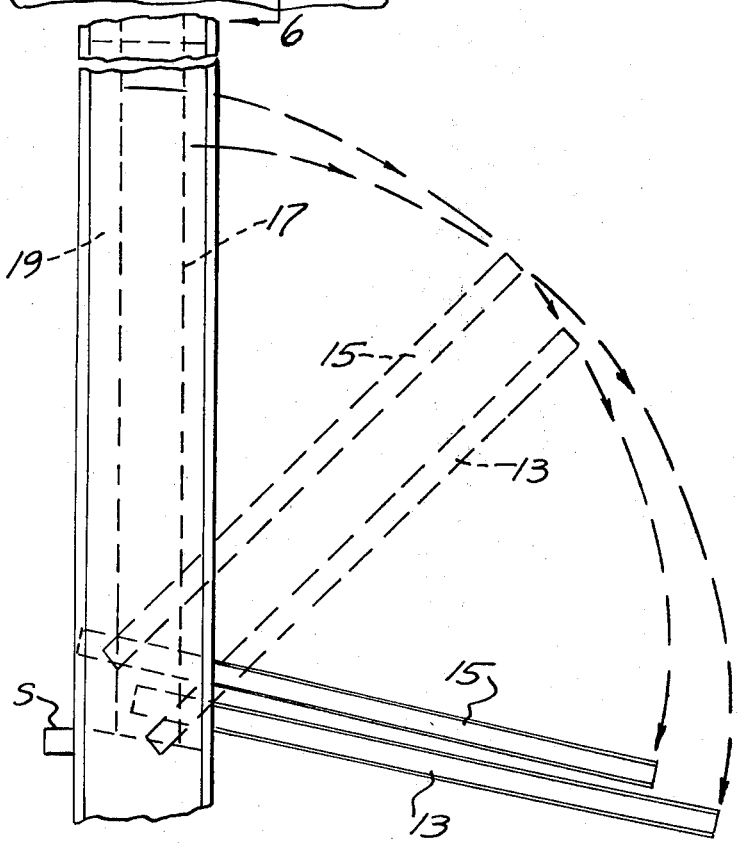
FIG. 2 is a fragmentary side elevational view thereof on an increased scale schematically indicating the lowering of the upper window sash and the progressive pivotal opening of the upper and lower sashes inwardly through an arc of 90° approximately.

The bayonet slot is so formed that upon rotation of the bolt 61 it is capable of further retraction to disengage the bolt from the slide channel. So disengaged, the corresponding upper or lower sash is adapted for outward pivotal movement to and through the positions shown in FIG. 2. Normally the upper sash is first lowered as in FIGS. 2 and 3.

Each of the upper and lower sashes includes a glass 67 retained in place in a conventional manner normally against a peripheral stop and retained thereon by a continuous wedge of putty or other retaining element.

Within the respective trackways and mounted upon the outer track 19 there is one, or a pair of outwardly projecting stops 69, FIG. 4, secured in position by fasteners 71. The stop is normally spaced below the upper window sash 15 and arranged at a position above the pivotal mounting 39 of the lower window sash when said lower window sash is in its lower-most position adjacent the sill S. This is illustrated in FIG. 4 for limiting downward movement of the upper sash. This facilitates inward pivotal movement of both window sashes through the dash line positions shown in FIG. 2 approximately 90° more or less. This provides a means of facilitating the cleaning of the exterior surfaces of the respective window sashes from the building interior.

Upon the interior of the window assembly and with respect to the opposed trackways 16 there is mounted upon the corresponding sides of frame F a thermal window 73, FIG. 6, including upright formed channel assembly 75 suitably retained upon the frame by a series of fasteners 91.

Each channel assembly includes a first upright inner channel 76 which extends from the sill throughout the height of the lower window sash. Opposed channels 76 are adapted to slidably receive bottom storm window 77, framed and glazed in a conventional manner.

Projecting from each channel assembly is a second channel 78 which extends a short distance downwardly from the top thereof. These second channels are in alignment with first channels 76. A suitably glazed and framed top storm window 79 at its upper sides is projected up into the second channels 77.

A third channel 81 extends along the lower edge of the top storm window and sealingly overlies the top edge of the lower storm window in alignment therewith. Said third channel is secured along the undersurface of the upper storm window by a series of fasteners 83, FIG. 6.

Also formed within each channel assembly at the upper ends thereof are fourth channels 85 which extends a short distance from the top thereof and arranged outwardly from and apart of the second channel 78. Channels 85 are adapted to supportably receive for storage the upper edges of a screen 87 which is suitably framed.

A fifth upturned channel element 86 projects inwardly from each of the channel assemblies 75 adjacent the upper end of the lower window sash and retainingly engages the lower end of the upper storm window, FIG. 6.

The respective fourth and fifth channels 85 and 86 provide a storage support of the screen 87 when not in use. Alternately when the screen is removed therefrom, lower storm window 77 may be removed from channels 76 and replaced by the screen. The lower storm window can be stored between the support channels 85 and 86.

Above the screen 87 shown in FIG. 6 and within the outer channel formation 85 there is a clearance recess 89 by which the screen or the stored storm may be first elevated and then disconnected from the lower channels 86 for removal thereof.

Having described my invention reference should now be had to the following claims.

I claim:

1. A window assembly for a building wall comprising a hollow frame including opposed sides, a sill and a header;

a trackway mounted upon and secured to each frame side including opposed inner and outer channel tracks of dovetail shape in cross section;

elongated opposed pairs of channel slides of dovetail shape in cross section movably mounted in opposed tracks respectively;

a window support bracket overlying each slide and adjacent its lower end pivotally mounted thereon;

a lower sash interposed between a pair of opposed support brackets and secured thereto;

an upper sash interposed between an additional pair of opposed support brackets and secured thereto;

the lower and upper sashes and connected channel slides adapted for vertical adjustments along the inner and outer tracks respectively;

the lower and upper sashes and connected support brackets adapted for selective inward pivotal movement approximately 90° to facilitate cleaning;

retractable latching means on said sashes engageable with the channel slides for securing the sashes within said tracks;

the outer surface of each channel slide having an elongated V-shaped groove;

the outer surface of each window support bracket having a corresponding V-shaped base normally nested and retained within the channel slide grooves respectively when said sashes are in an upright position, and are angularly displaced from said grooves when the sashes are pivoted inwardly;

the pivotal mounting of each window support bracket including a bolt within a channel slide projecting inwardly thereof and through a window bracket;

and a coiled compression spring anchored upon said bolt and bearing against the window bracket, normally biasing the bracket base into the slide groove;

the slide camming said bracket inwardly on rotation thereof, against the action of said spring for biasing the window sash and bracket in any selected angular position of adjustment, said window brackets on return rotation adapted to snap into said slide grooves respectively;

the securing of a sash between a pair of support brackets including opposed spaced inwardly directed channels on said brackets, the sides of each window sash being nested and retained within said channels respectively;

and fasteners securing said brackets to said window sashes respectively;

said latching means including a manually retractable bolt nested within an upper portion of each window sash and longitudinally projected into a corresponding recess in an adjacent channel slide;

and a latch plate on said sash having a bayonet slot for guidably retaining said bolt in a locking position, and permitting rotation and retraction thereof to disconnect the bolt from the channel slide.

* * * * *